US009168765B2

(12) United States Patent
Kawamura

(10) Patent No.: US 9,168,765 B2
(45) Date of Patent: Oct. 27, 2015

(54) PRINTING APPARATUS

(71) Applicant: CANON KABUSHIKI KAISHA, Tokyo (JP)

(72) Inventor: Takuya Kawamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/494,426

(22) Filed: Sep. 23, 2014

(65) Prior Publication Data

US 2015/0085016 A1 Mar. 26, 2015

(30) Foreign Application Priority Data

Sep. 25, 2013 (JP) ..... 2013-197824

(51) Int. Cl.

| | |
|---|---|
| ***B41J 23/00*** | (2006.01) |
| ***B41J 11/00*** | (2006.01) |
| ***B41J 2/165*** | (2006.01) |
| *B41J 19/20* | (2006.01) |

(52) U.S. Cl.
CPC ..... *B41J 11/002* (2013.01); *B41J 2/1652* (2013.01); *B41J 19/202* (2013.01)

(58) Field of Classification Search
CPC ..... B41J 19/202; B41J 25/34; B41J 25/308; B41J 19/005; B41J 25/001; B41J 19/20; B41J 19/142; B41J 25/006; B41J 11/002; B41J 11/0015; B41J 2/01; G01D 15/18; C09D 11/101; B41M 7/0081
See application file for complete search history.

(56) References Cited

U.S. PATENT DOCUMENTS

| | | | | |
|---|---|---|---|---|
| 2002/0054185 | A1* | 5/2002 | Kinoshita | 347/35 |
| 2006/0187257 | A1* | 8/2006 | Ito | 347/35 |
| 2013/0257943 | A1* | 10/2013 | Toya et al. | 347/9 |
| 2014/0085365 | A1* | 3/2014 | Kasahara et al. | 347/10 |

FOREIGN PATENT DOCUMENTS

JP 2012-045855 A 3/2012

* cited by examiner

*Primary Examiner* — Lisa M Solomon
(74) *Attorney, Agent, or Firm* — Canon USA Inc. IP Division

(57) ABSTRACT

A printing apparatus includes a carriage configured to perform a reciprocating movement while facing a sheet, the carriage being equipped with an inkjet head, and a drying unit configured to apply energy from above the carriage to the sheet so as to dry ink, wherein, when the carriage performs the reciprocating movement, the carriage is reversed at a reversing position where the application of the energy to an end of the sheet or an end of an image formed on the sheet is not blocked by the carriage.

7 Claims, 9 Drawing Sheets

PRINTING APPARATUS

BACKGROUND OF THE INVENTION

1. Field of the Invention

The present invention relates to an inkjet printing apparatus that performs heating for fixing ink.

2. Description of the Related Art

The technical field of performing printing for providing printed products which exhibit high weather resistance for use at an outdoor exhibition and the like has attracted attention. According to Japanese Patent Application Laid-Open No. 2012-45855, emulsion ink applied on a sheet having poor absorbency is heated so that a film is formed, whereby the ink is solidified and fixed on an ink-applied surface of the sheet. The heating is performed by irradiating the ink-applied surface of the sheet with infrared light.

According to Japanese Patent Application Laid-Open No. 2012-45855, a carriage moves reciprocally between a drying unit and an ink-applied surface of a sheet. Therefore, radiated infrared light is partially blocked by the carriage thus moving. In an area where the carriage moves, infrared light which irradiates a certain position is blocked for a moment of time when the carriage passes, and an irradiation time at each position in the area is made substantially uniform.

What matters here are the moments of time when the moving direction of the carriage is reversed when the carriage performs a reciprocating movement. An inkjet head is smaller than a structure of the carriage that holds the inkjet head. At a reversing position, the structure of the carriage blocks infrared light to be radiated onto an end of an image area on the sheet on which ink has been just applied. Further, at the reversing position, the carriage stops and stays for a certain period of time, and the infrared light irradiation time for the image area that is behind the carriage is shorter than the infrared light irradiation time for other image regions. This can be a factor that causes an insufficient dried state of the image end part, and further, color unevenness of an image.

SUMMARY OF THE INVENTION

Based on the recognition of the issue, the present invention is directed to a printing apparatus including a drying unit that dries ink by applying drying energy from above a carriage, wherein the position where the carriage is reversed is optimized so that an entire image is equally dried, whereby uniformity of image quality is enhanced.

According to an aspect of the present invention, a carriage configured to perform a reciprocating movement while facing a sheet, the carriage being equipped with an inkjet head, and a drying unit configured to apply energy from above the carriage to the sheet so as to dry ink, wherein, when the carriage performs the reciprocating movement, the carriage is reversed at a reversing position where the application of the energy to an end of the sheet or an end of an image formed on the sheet is not blocked by the carriage.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
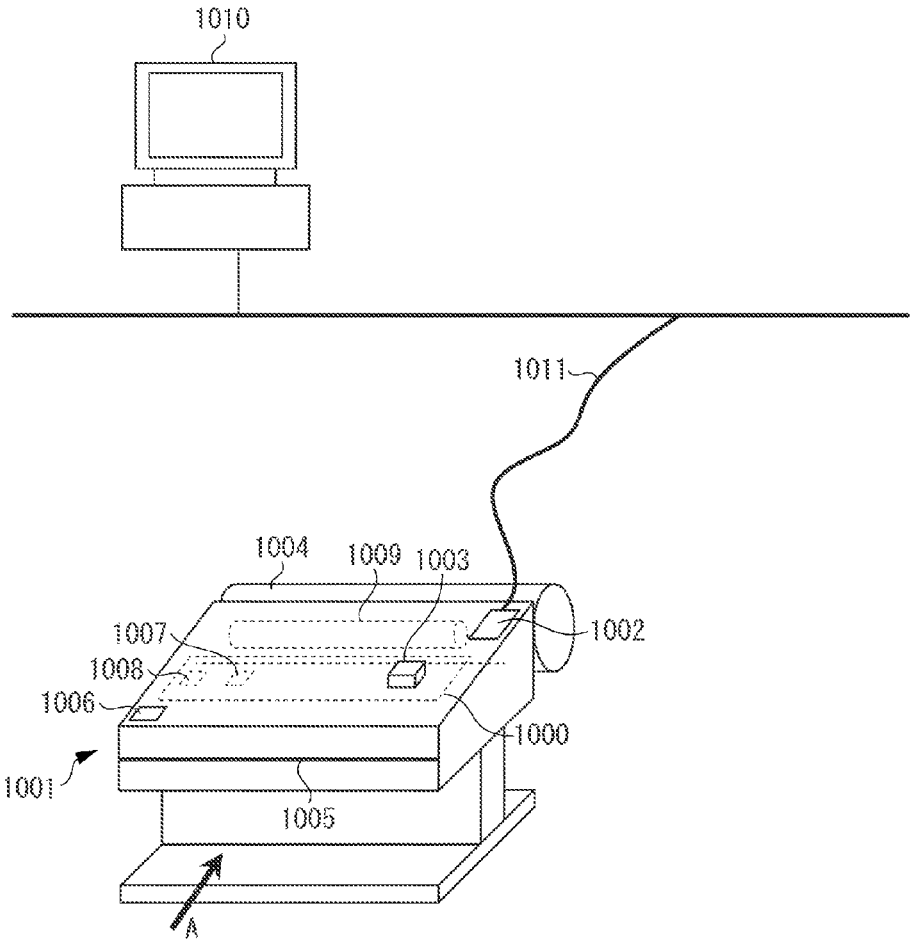
FIG. 1 is a diagram illustrating an overall configuration of a printing apparatus.

FIG. 1 is a diagram illustrating an overall configuration of a printing apparatus according to an exemplary embodiment. The printing apparatus is an inkjet printing apparatus (hereinafter referred to as an "apparatus") 1001, and includes a control unit 1002. A carriage 1003 on which an inkjet head 500 is mounted performs a reciprocating movement, while facing a sheet. The reciprocating movement of the carriage 1003 is arranged in a direction intersecting a direction in which the sheet is conveyed. On the inkjet head, a plurality of ink discharge ports for discharging ink is arranged in a direction toward the moving direction of the carriage 1003. The apparatus 1001 includes a sheet supply unit 1004, and a sheet discharge unit 1005. A sheet on which an image is printed by the inkjet head 500 is cut by a cutter provided in a vicinity of the discharge unit, and is discharged from the discharge unit 1005. Through an operation unit 1006, a user instructs various types of operations to the apparatus 1001. Further, a platen 1000 that faces the carriage 1003 and supports a sheet is provided. The platen 1000 is provided with receiving units 1007 and 1008 that receive ink discharged from an inkjet head 500, on an outer side than an end of the sheet. The receiving units 1007 and 1008 are provided at positions according to sizes of a plurality of types of sheets that are supposed to be used. The positions of the receiving units are not limited to the positions of the receiving units 1007 and 1008, and further receiving units may be added at a plurality of positions according to the sizes of the sheets. An operation of discharging ink to the receiving units located on an outer side than the sheet end is referred to as "a preliminary discharge", and is performed separately from the discharge onto the sheet, in order to maintain a state of the inkjet head. A drying unit 1009 irradiates the sheet with electromagnetic wave, such as infrared light or ultraviolet light, as drying energy for drying ink, from above the carriage 1003. A host personal computer (PC) 1010 is connected to a local area network (LAN). A network 1011 is the LAN to which the apparatus 1001 is connected. The present exemplary embodiment describes a configuration example including a network connection unit as an external interface (I/F) unit. Alternately, the configuration may be realized with the connection by a universal serial bus (USB) and the like as an external I/F unit.

Figure 2:
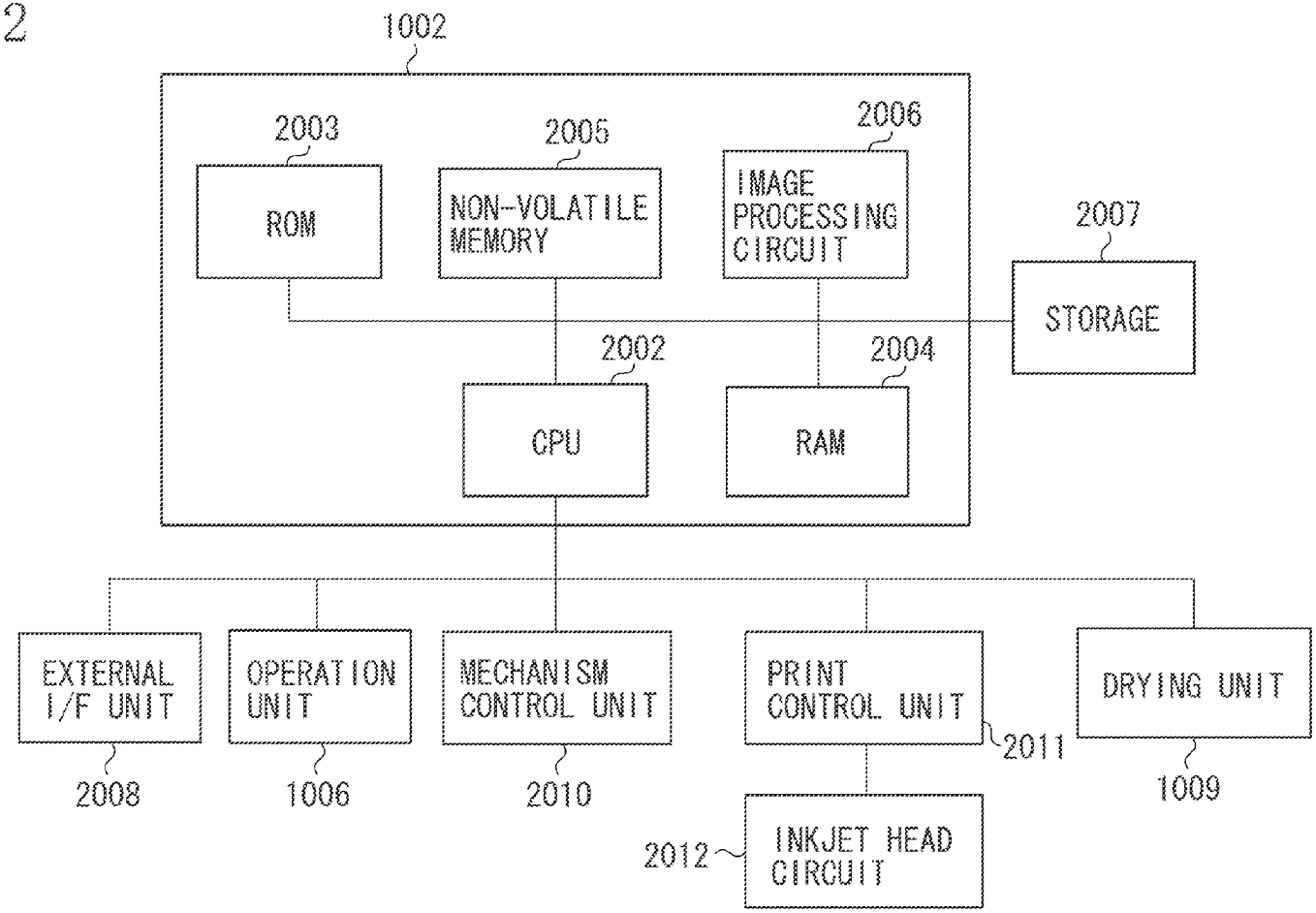
FIG. 2 is a diagram illustrating a system block configuration of the printing apparatus.

FIG. 2 is a diagram illustrating a system block configuration of the printing apparatus according to the present exemplary embodiment. A control unit 1002 controls the apparatus 1001. The control unit 1002 includes a central processing unit (CPU) 2002. The control unit 1002 performs controlling operations by executing a program read from a read-only memory (ROM) 2003. In a random access memory (RAM) 2004, there are provided a data memory area where externally received print data and image data received from a printer controller are stored, and a work memory area for execution of a program by the control unit 1002. A non-volatile memory 2005 is constituted by a flash ROM, an electrically erasable programmable read-only memory (EEPROM), and the like. In the non-volatile memory 2005, values currently set in the apparatus 1001 (for example, values set for respective types of sheets) are stored in a non-volatile manner independently from an electric power supply. An image processing circuit 2006 of the control unit 1002 processes each pixel data of image data received from the printer controller, and outputs a head data signal to be sent to the inkjet head. A storage 2007 stores printing job data received from an external I/F unit 2008 as a file. The external I/F unit 2008 is capable of performing transmission/reception by a network connection protocol, such as an internet protocol (IP). The operation unit 1006 displays a message from the CPU 2002 to the user on a liquid crystal display (LCD), with light emitting diodes (LED), and the like, and an instruction from the user is input to the apparatus 1001 by key inputting. A mechanism control unit 2010 controls a driving portion for a sheet supply unit (not illustrated), a driving portion for a cutter, a driving portion for a sheet discharge unit, a driving portion for sheet conveyance, and the like. A print control unit 2011 controls an ink supply unit and a carriage driving unit that are not illustrated. Further, the print control unit 2011 drives the carriage 1003 so as to perform printing on a sheet in synchronization with the mechanism control unit 2010. An inkjet head circuit 2012, under control of the print control unit 2011, discharges ink from head nozzles. The drying unit 1009 is also controlled via the CPU 2002.

An optimal reversing position of the carriage 1003 will be described below with reference to FIGS. 3A through 6. The longer the distance of the reciprocating movement of the carriage 1003 is, the more time is required for the movement, and consequently a printing time per one sheet is increased. In order to improve print throughput while maintaining high quality of images, the reversing position of the carriage 1003 is optimized.

FIGS. 3A through 6 are diagrams each illustrating a cross-sectional view of the apparatus, viewing along a direction indicated by an arrow A illustrated in FIG. 1. The right side of the sheet is defined as a "home position", while the left side of the sheet is defined as a "back position". A sheet 3000 is conveyed in a direction from back to front side on the sheet of FIGS. 3A and 3B when viewed from the front. During the reciprocating movement of the carriage 1003, ink is discharged from the inkjet head 500, and an image 3001 is formed. The formed image 3001 is heated by the drying unit 1009 from above the carriage 1003.

With reference to FIGS. 3A, 3B, 4A, and 4B, the reversing position of the carriage 1003, in a case where the preliminary discharge is not performed during image formation, is described. The configuration illustrated in FIGS. 3A and 3B and the configuration illustrated in FIGS. 4A and 4B have a common characteristic that the preliminary discharge is not performed during the image formation, but these configurations are different from each other regarding the width of a formed image and the reversing position of the carriage 1003.

Figure 3A:
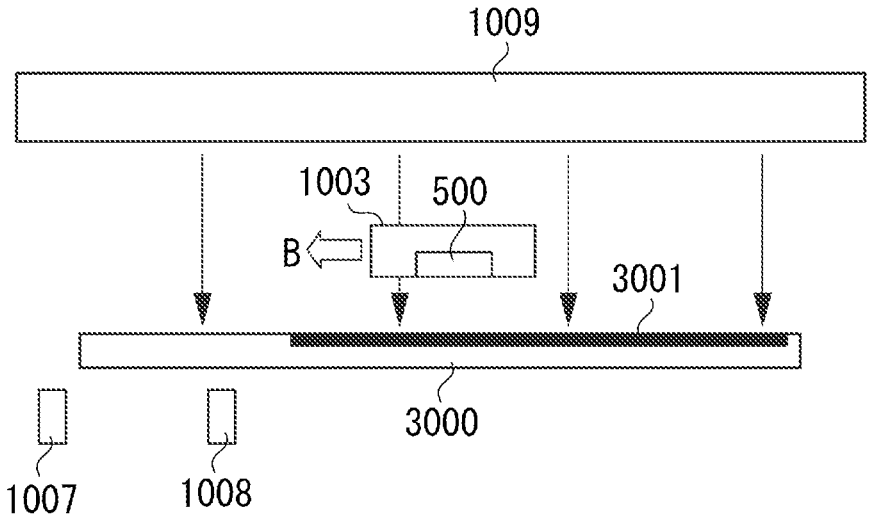
FIGS. 3A and 3B are diagrams each illustrating a cross-sectional view of the printing apparatus while the printing apparatus is performing a printing operation.
Figure 3B:
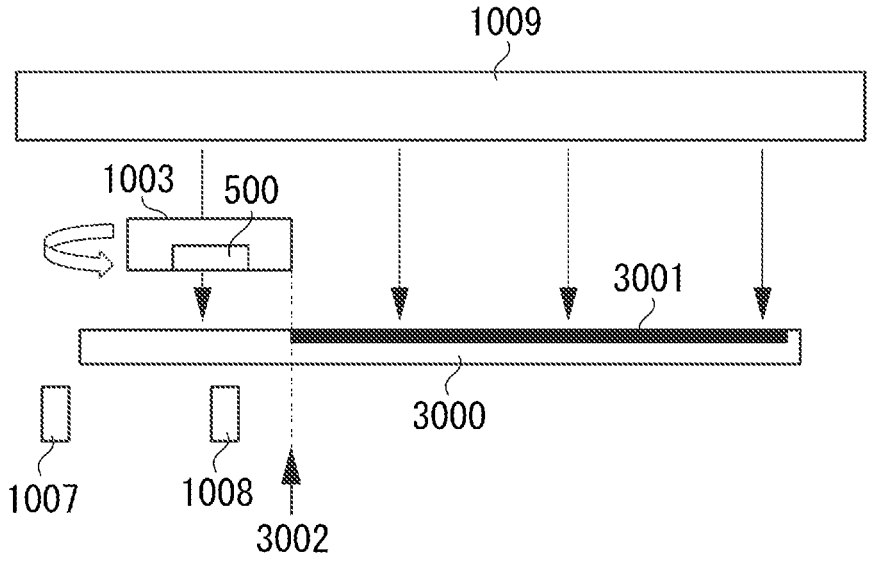

FIGS. 3A and 3B are diagrams illustrating the operation and the reversing position of the carriage 1003 in a case where the formed image 3001 has a width narrower than the width of the sheet 3000 (margin printing). When ink is discharged from the inkjet head 500 so that an image of one band is formed, as illustrated in FIG. 3A, the carriage 1003 passes over the image 3001 in a direction indicated by an arrow B at a uniform speed. Then, as illustrated in FIG. 3B, at a position where the heat being radiated to the image 3001 is not blocked by the carriage 1003, the carriage 1003 is reversed. In other words, after the printing of one band is completed, when an end of the carriage 1003 on an inner side (a side closer to the formed image) reaches a position 3002, the carriage 1003 is reversed. In this way, by reversing the carriage 1003 at the position 3002, the movement time of the carriage 1003 is not idly let to increase. Besides, as the heat being radiated to the end of the image 3001 is not blocked by the carriage upon the reversing, the formed image can be heated uniformly. In other words, both of the improvement of the print throughput and the high-quality image formation without unevenness can be achieved.

Figure 4A:
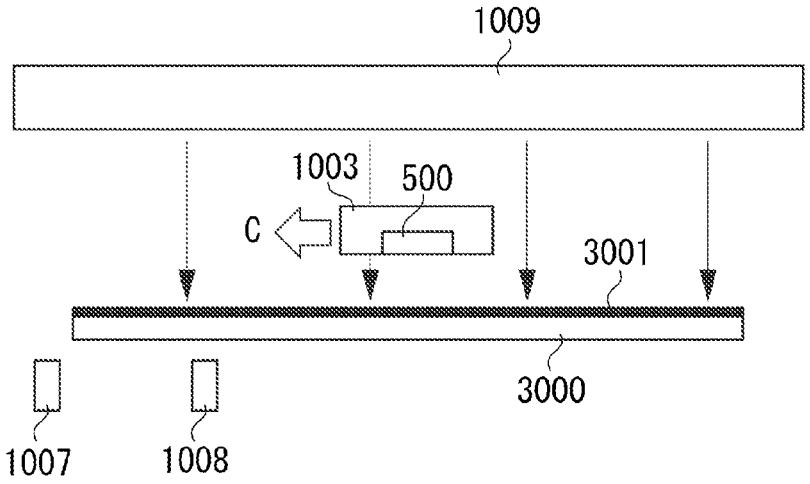
FIGS. 4A and 4B are diagrams each illustrating a cross-sectional view of the printing apparatus while the printing apparatus is performing a printing operation.
Figure 4B:
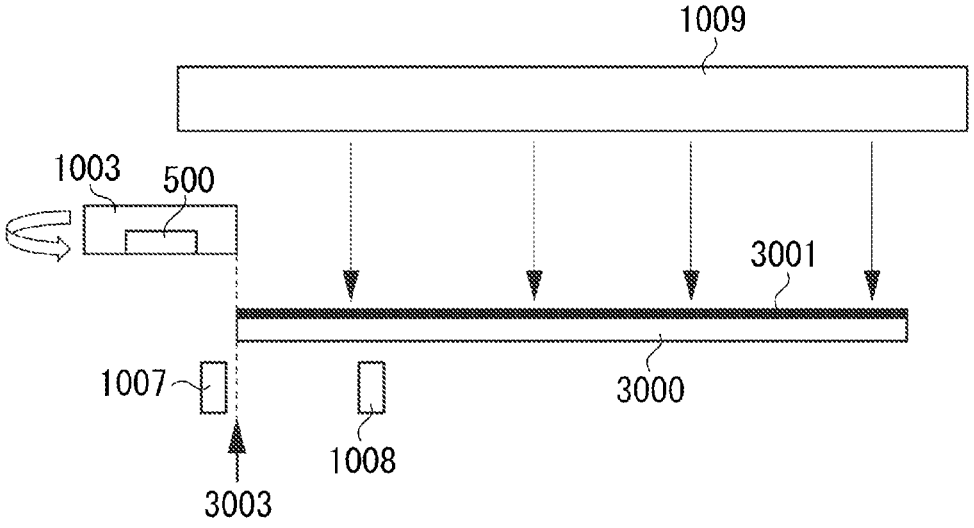

FIGS. 4A and 4B are diagrams illustrating the operation and the reversing position of the carriage 1003 in a case where a formed image 3001 has a width equal to the width of the sheet 3000 (marginless printing). When ink is discharged from the inkjet head 500 so that an image of one band is formed, as illustrated in FIG. 4A, the carriage 1003 passes over the image 3001 in a direction indicated by an arrow C at a uniform speed. Then, as illustrated in FIG. 4B, at a position where the heat being radiated to the image 3001 is not blocked by the carriage 1003, the carriage 1003 is reversed. In other words, after the printing of one band is completed, when the end of the carriage 1003 on the inner side (the side closer to the formed image) reaches the sheet end 3003, the carriage 1003 is reversed. In the way describe above, by reversing the carriage 1003 at the position 3003, both of the improvement of the print throughput and the high-quality image formation without unevenness can be achieved.

Even in a case where the image width is narrower than the width of the sheet, the heating of the entire sheet up to the ends thereof consequently stabilizes the temperature of the image as a whole. In such a case, even in the margin printing as illustrated in FIGS. 3A and 3B, the carriage may be reversed at the reversing position as illustrated in FIGS. 4A and 4B.

Figure 5A:
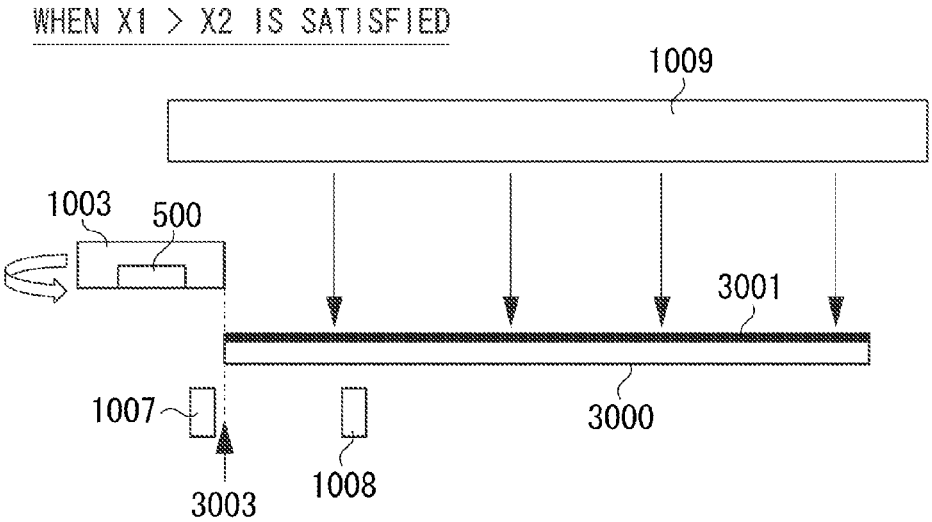
FIGS. 5A and 5B are diagrams each illustrating a cross-sectional view of the printing apparatus while the printing apparatus is performing a printing operation.
Figure 5B:
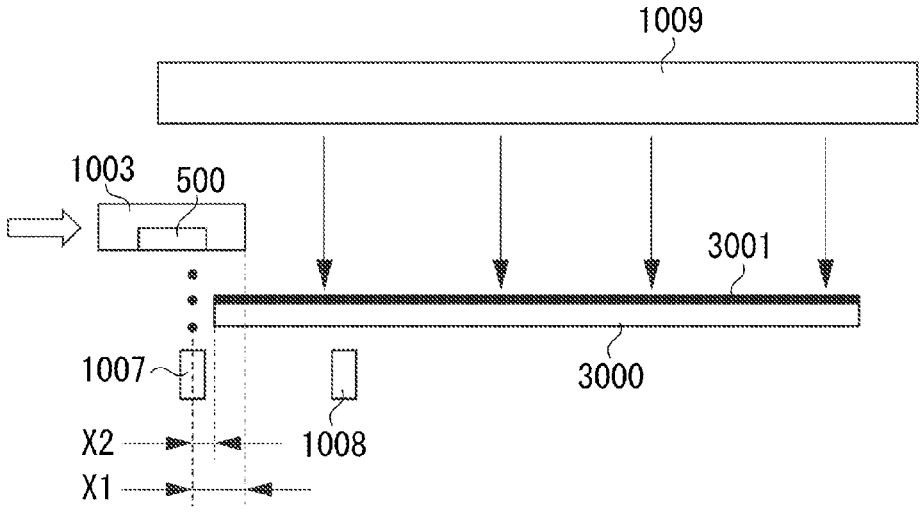
Figure 6:
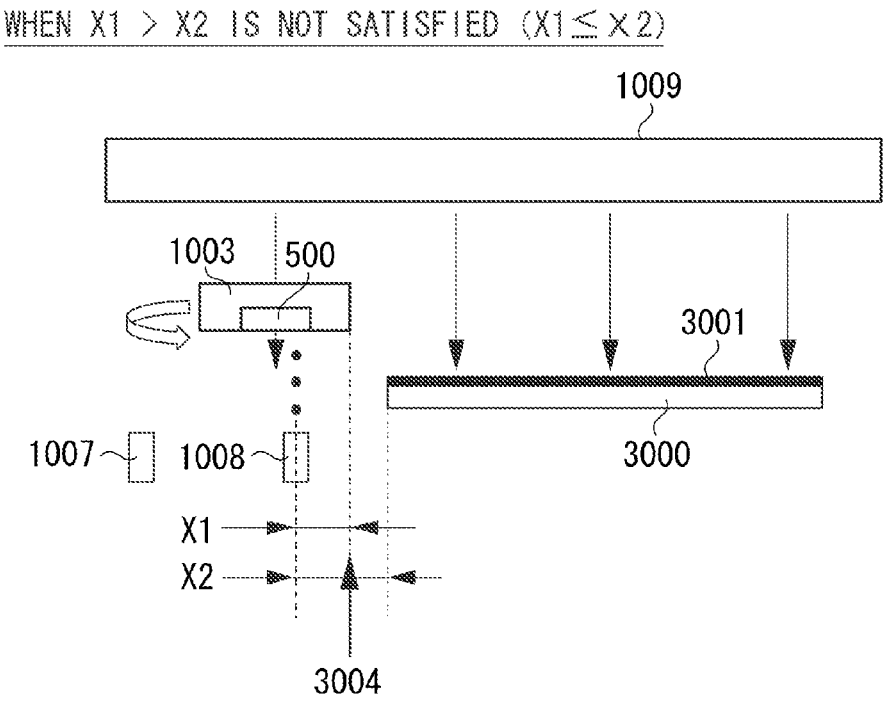
FIG. 6 is a diagram illustrating a cross-sectional view of the printing apparatus while the printing apparatus is performing a printing operation.

With reference to FIGS. 5A, 5B, and 6, the reversing position of the carriage 1003, in a case where the preliminary discharge is performed during image formation, will be described below. In order to minimize the printing time, the preliminary discharge should be performed at a receiving unit as close to the sheet end as possible. Since there are many types of sheet sizes, there are various types of position relationships between the sheet end and the receiving unit. According to the present exemplary embodiment, the carriage reversing position is determined with reference to the following condition:

$$X1>X2 \quad (1),$$

where X1 represents a distance from an end of the carriage (an end thereof on the inner side) to one of the ink discharge ports that is closest to the carriage end. X2 represents a distance from an end of a sheet being used to the ink discharge port closest to the carriage end (the end on the inner side) (see FIGS. 5B and 6).

In a case where the relationship of the expression (1) is satisfied (i.e., X1>X2) (a first mode), an operation of the preliminary discharge as illustrated in FIGS. 5A and 5B is executed. In a case where the relationship of the expression (1) is not satisfied (i.e., X1≤X2) (a second mode), the operation of the preliminary discharge as illustrated in FIG. 6 is executed.

FIGS. 5A and 5B are diagrams illustrating the operation in the first mode. As illustrated in FIG. 5A, the carriage 1003 is reversed at a position where the heat being radiated to the image 3001 is not blocked by the carriage 1003. In other words, after the printing of one band is completed, when the end of the carriage 1003 on the inner side reaches the sheet end 3003, the carriage 1003 is reversed. Then, as illustrated in FIG. 5B, as the carriage is moving toward the sheet 3000, the preliminary discharge of ink from the inkjet head 500 is performed toward the receiving unit 1007. When the preliminary discharge is performed, the carriage 1003 is not reversed on the sheet 3000. Alternatively, the preliminary discharge is performed toward the receiving unit 1007 while the carriage 1003 is moving in a direction in which the carriage recedes from the sheet 3000. The carriage 1003 is then reversed at the reversing position illustrated in FIG. 5A.

FIG. 6 is a diagram illustrating the operation in the second mode. In this example, the sheet 3000 has a width smaller than that in the previous example illustrated in FIGS. 5A and 5B. The receiving unit 1008, which is closest to the end of the sheet 3000, is used for the preliminary discharge. After the printing of one band is completed, the carriage 1003 performs reversing for the reciprocating movement at a reversing position 3004 immediately above the receiving unit 1008 (a position where an end row of the discharge ports of the inkjet head 500 comes to immediately above the receiving unit 1008). Then, at the reversing position 3004, when the carriage 1003 is reversed, the preliminary discharge is performed toward the receiving unit 1008.

Figure 7:
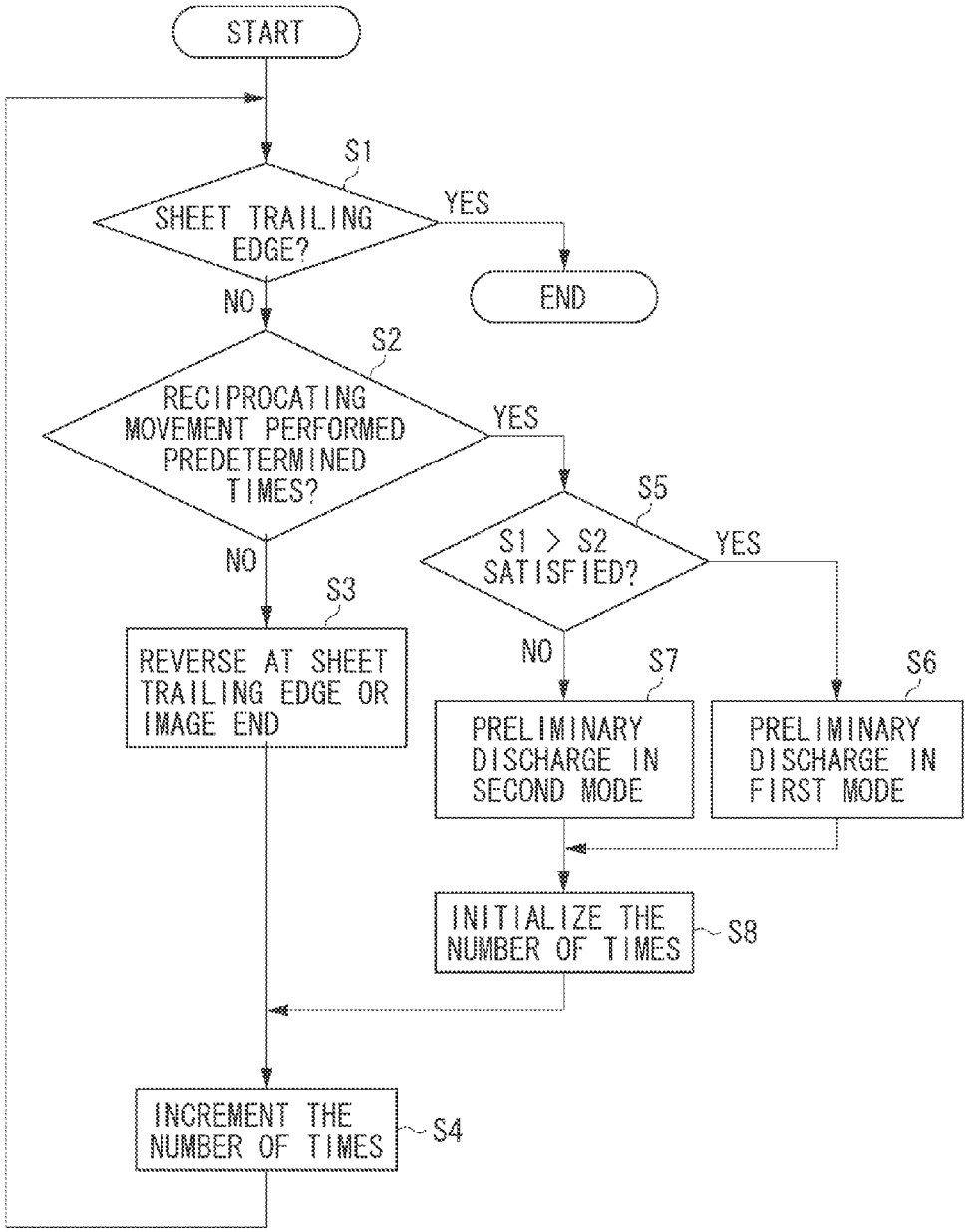
FIG. 7 is a flowchart illustrating an operation sequence for determining a carriage reversing position.

FIG. 7 is a flowchart illustrating an operation sequence during printing. This operation sequence is specified by a program executed by the control unit 1002. When the user inputs print information in the operation unit 1006, the print information is transmitted to the control unit 1002. Upon the transmission, the number of times of the reciprocating movement of the carriage 1003 is initialized and printing starts. During printing, the number of times of the reciprocating movement of the carriage 1003 is counted.

When printing starts, then in step S1, whether the printing position reaches a sheet trailing edge is determined. In a case where the printing position does not reach the sheet trailing edge (NO in step S1), the processing proceeds to step S2. In step S2, whether the number of times of the reciprocating movement of the carriage 1003 has reached a predetermined number of times is determined. The predetermined number of times is set by considering the time required for the carriage 1003 to perform one reciprocating movement and a period of time from the previous preliminary discharge until when ink is dried and the preliminary discharge becomes needed. The predetermined number of times is set to 10 in the present exemplary embodiment.

In the determination in step S2, in a case where the number of times of the reciprocating movement of the carriage 1003 is determined not to have reached to the predetermined number of times (NO in step S2), the processing proceeds to step S3. Then, the carriage 1003 is reversed at the sheet end or the image end, as described above with reference to FIGS. 3A to 4B. In step S4, incrementing of the times of the reciprocating movement of the carriage 1003 is continued, and the processing returns to step S1 to determine whether the printing position reaches the sheet trailing edge.

In step S2, in a case where the number of times of the reciprocating movement of the carriage 1003 is determined to have reached the predetermined number (YES in step S2), the processing proceeds to step S5. In step S5, whether the condition of the expression (1), i.e., X1>X2, is satisfied is determined. In a case where the condition of the expression (1) is satisfied (YES in step S5), the processing proceeds to step S6. In step S6, the preliminary discharge in the first mode is performed, as described above with reference to FIGS. 5A and 5B. On the other hand, in a case where the condition of the expression (1) is not satisfied (NO in step S5), the processing proceeds to step S7. In step S7, the preliminary discharge in the second mode is performed, as described above with reference to FIG. 6. After the preliminary discharge is executed in either the first mode or the second mode, the processing proceeds to step S8. In step S8, the number of times of the reciprocating movement of the carriage 1003 is initialized. Then, the processing proceeds to step S4. In step S4, the number of times of the reciprocating movement of the carriage 1003 is incremented again, and the processing returns to step S1. The above-described processing is repeated until it is determined in step S2 that the printing is completed up to the sheet trailing edge.

Figure 8:
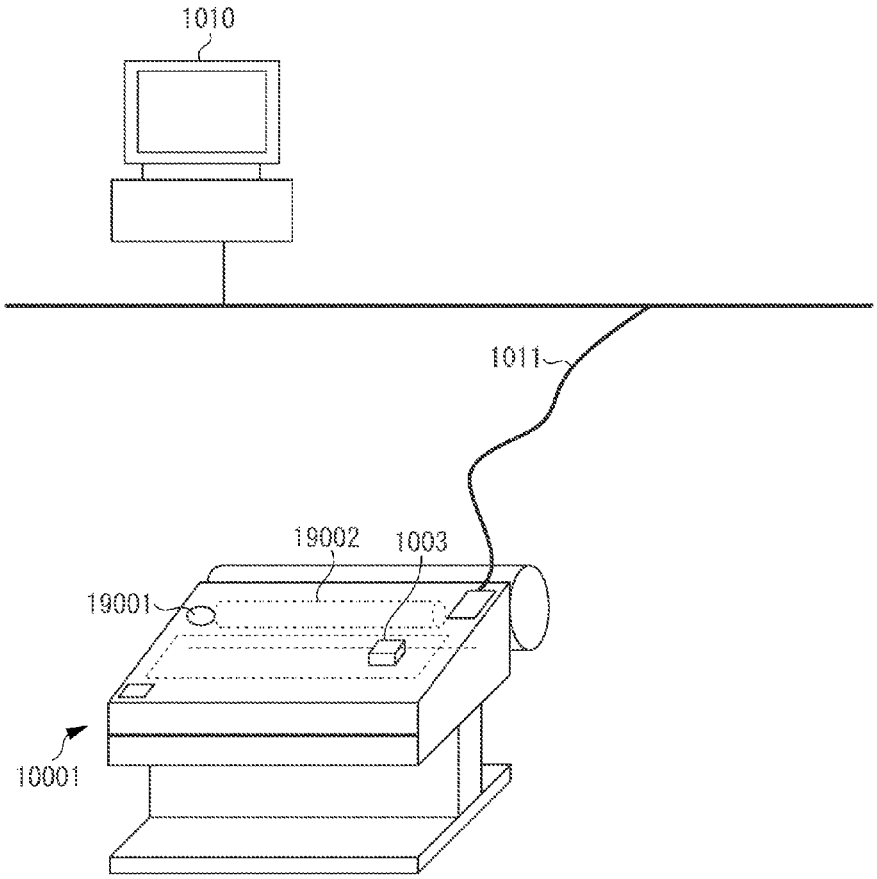
FIG. 8 is a diagram illustrating a modification example of the configuration illustrated in FIG. 1.
Figure 9:
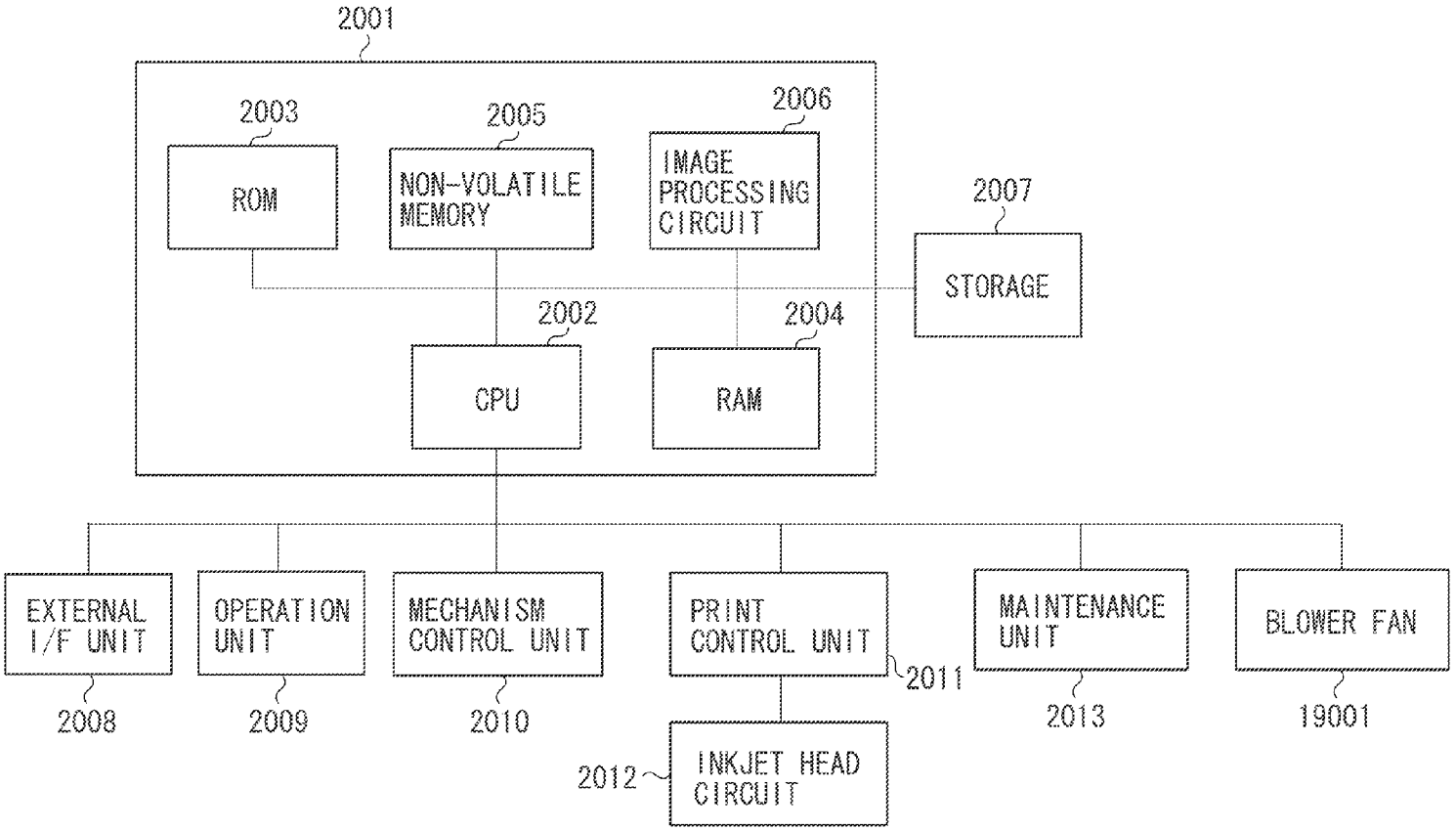
FIG. 9 is a diagram illustrating a modification example of the configuration illustrated in FIG. 2.

FIG. 8 and FIG. 9 are diagrams illustrating a modification example where the configuration of the drying unit is modified so as to send heated air toward a sheet to spray the heated air over the sheet. A blower fan 19001 includes a heater inside, and is capable of generating warm air. An air duct 19002 sprays warm air from above the carriage 1003 to a sheet so as to dry ink. Outside air sucked through an inlet opening of the blower fan 19001 is sprayed from the air duct 19002 to the sheet.

The above-described example according to the exemplary embodiment is for explaining the reversing position at which the carriage 1003 is reversed on the back position side. Alternatively, the same processing may be performed on the home position side. Further, by taking component tolerance and an ink discharge error of the carriage 1003 into consideration, the carriage 1003 may be reversed at a position further receding from the image 3001 as compared with the above-described reversing position. For example, the position may be shifted 5 mm to the left side from the position 3003 illustrated in FIGS. 5A and 5B. On the other hand, in a case where there are smaller influences even if the carriage 1003 blocks a part of the end of the image 3001, the carriage 1003 may be reversed at a position where the carriage 1003 blocks a part of the image end or the sheet end. For example, the position may be shifted 5 mm to the right side from the position 3003 illustrated in FIGS. 5A and 5B.

According to the present exemplary embodiment, in a printing apparatus including a drying unit that applies drying energy from above a carriage so as to dry ink, the carriage reversing position is optimized according to a situation. With the optimization, an entire image is equally dried, thereby improving uniformity of image quality and improving print throughput are realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-197824 filed Sep. 25, 2013, which is hereby incorporated by reference herein in its entirety.

What is claimed is:

1. A printing apparatus comprising:

a carriage configured to perform a reciprocating movement in a direction toward a sheet, the carriage being equipped with an inkjet head;

a platen configured to support the sheet facing to the carriage, wherein the platen is provided with a receiving unit, which receives ink discharged from the inkjet head, on an outer side than the end of the sheet; and a drying unit configured to apply energy from above the carriage to the sheet so as to dry ink, wherein, when the carriage performs the reciprocating movement, the carriage is reversed at a reversing position where the application of the energy to an end of the sheet or an end of an image formed on the sheet is not blocked by the carriage, wherein, in a case where an preliminary discharge is performed by discharging ink from the inkjet head to the receiving unit, either a first mode in which the preliminary discharge is performed while the carriage is moving in the direction, or a second mode in which the preliminary discharge is performed at the reversing position, is performed, and the first mode is performed when X1>X2 is satisfied, and the second mode is performed when X1>X2 is not satisfied, where X1 represents a distance from an end of the carriage to an ink discharge port that is closest to the end of the carriage, and X2 represents a distance from an end of a sheet being used to an ink discharge port that is closest to the end of the sheet, when the carriage is moved to the position where the preliminary discharge is performed.

2. The printing apparatus according to claim 1, wherein, before a number of times of the reciprocating movement reaches a predetermined number, the carriage is reversed at the reversing position, and the preliminary discharge in the first mode or the second mode is not performed.

3. The printing apparatus according to claim 1, wherein the platen is provided with a plurality of the receiving units at positions corresponding to sizes of a plurality of types of sheets that are supposed to be used, and the preliminary discharge is performed to one of the receiving units that is closest to an end of a sheet.

4. The printing apparatus according to claim 1, wherein the drying unit irradiates the sheet with electromagnetic wave or heats the sheet with heated air.

5. A printing apparatus comprising:

a carriage configured to perform a reciprocating movement in a direction toward a sheet, the carriage being equipped with an inkjet head;

a platen configured to support the sheet facing to the carriage, wherein the platen is provided with a receiving unit, which receives ink discharged from the inkjet head, on an outer side than the end of the sheet; and a drying unit configured to apply energy from above the carriage to the sheet so as to dry ink, wherein, when the carriage performs the reciprocating movement, the carriage is reversed at a reversing position where the application of the energy to an end of the sheet or an end of an image formed on the sheet is not blocked by the carriage, wherein, in a case where an preliminary discharge is performed by discharging ink from the inkjet head to the receiving unit, either a first mode in which the preliminary discharge is performed while the carriage is moving in the direction, or a second mode in which the preliminary discharge is performed at the reversing position, is performed, and wherein, before a number of times of the reciprocating movement reaches a predetermined number, the carriage is reversed at the reversing position, and the preliminary discharge neither in the first mode nor the second mode is performed.

6. The printing apparatus according to claim 5, wherein the platen is provided with a plurality of the receiving units at positions corresponding to sizes of a plurality of types of sheets that are supposed to be used, and the preliminary discharge is performed to one of the receiving units that is closest to an end of a sheet.

7. The printing apparatus according to claim 5, wherein the drying unit irradiates the sheet with electromagnetic wave or heats the sheet with heated air.

* * * * *